US005712643A

United States Patent [19]

Skladany

[11] Patent Number: 5,712,643

[45] Date of Patent: Jan. 27, 1998

[54] PLANAR MICROSTRIP YAGI ANTENNA ARRAY

[75] Inventor: James M. Skladany, Somersworth, N.H.

[73] Assignee: CushCraft Corporation, Manchester, N.H.

[21] Appl. No.: 568,735

[22] Filed: Dec. 5, 1995

[51] Int. Cl.[6] ..... H01Q 1/38; H01Q 21/12

[52] U.S. Cl. ..... 343/700 MS; 343/815; 343/818; 343/795

[58] Field of Search ..... 343/700 MS, 815, 343/818, 816, 817, 819, 820, 792.5, 795, 846, 778

[56] References Cited

U.S. PATENT DOCUMENTS

| | | | |
|---|---|---|---|
| 3,599,217 | 8/1971 | Grant | 343/815 |
| 4,103,303 | 7/1978 | Regenos et al. | 343/815 |
| 4,118,706 | 10/1978 | Kerr | 343/700 |
| 4,347,517 | 8/1982 | Kaloi | 343/700 MS |
| 4,800,461 | 1/1989 | Dixon et al. | 361/398 |
| 4,812,855 | 3/1989 | Coe et al. | 343/815 |
| 5,012,256 | 4/1991 | Maddocks | 343/815 |
| 5,175,047 | 12/1992 | McKenney et al. | 428/209 |
| 5,220,335 | 6/1993 | Huang | 343/700 |
| 5,627,550 | 5/1997 | Sanad | 343/700 MS |

FOREIGN PATENT DOCUMENTS

| | | | |
|---|---|---|---|
| 138384 | 10/1982 | Germany | 343/700 MS |

OTHER PUBLICATIONS

John Huang, "Microstrip Yagi Array Antenna for Mobile Satellite Vehicle Application", IEEE vol. 39, No. 7, Jul. 1991, pp. 1024–1030.

Chen et al; "Optimum Element Lengths For Yagi–Uda Arrays"; Jan. 1975; pp. 8–15; vol. AP–23, No. 1 IEEE Transactions on Antennas & Propagation.

Rizzi; "Microwave Engineering Passive Circuits"; 1988; pp. 358–363; Prentice–Hall, Inc. No Month.

Chatterjee; "Elements of Microwave Engineering"; 1986; pp. 266–277; Ellis Horwood Limited No Month.

*Primary Examiner*—Donald T. Hajec
*Assistant Examiner*—Tan Ho
*Attorney, Agent, or Firm*—Hayes, Soloway, Hennessey, Grossman & Hage, P.C.

[57] ABSTRACT

A multi-element directional antenna and process for making same are described. The antenna comprises a lightweight dielectric substrate having an array of parasitic elements disposed on the substrate. A printed circuit board having a ground plane on one side thereof, and a driven element and phasing means comprising a hybrid (magic-or-twin) tee junction on the other side thereof, disposed coplanar with the parasitic elements and the substrate. The multi-element directional antenna, may be formed using low labor cost manufacturing process such as stamping and laminating, and additive and/or subtractive (i.e. etching) techniques.

12 Claims, 3 Drawing Sheets

PLANAR MICROSTRIP YAGI ANTENNA ARRAY

FIELD OF THE INVENTION

This invention relates generally to antennas, and in particular to planar microstrip antenna structures. The invention has particular utility in connection with Yagi-type antennas, and will be described in connection with such utility, although other utilities are contemplated.

BRIEF DESCRIPTION OF THE PRIOR ART

Previous to this disclosure, the prior art has provided different design approaches to achieve a Yagi-type antenna. Among the patents bearing on this particular concept will be found the following:

| Patentee | Patent No. | Date |
|---|---|---|
| Huang | 5,220,335 | June 15, 1993 |
| Kerr | 4,118,706 | October 3, 1978 |

The Huang patent discloses a planar microstrip Yagi-type antenna, having a driven element, reflector patches, and one or more director patches, disposed on a dielectric substrate. According to Huang a ground plane that spans the entire length and width of the dielectric substrate is required to produce the necessary reflection. This ground plane adds substantially to the overall weight and cost of the Huang antenna. In addition, Huang reports that a material with a relatively large dielectric constant should be employed; otherwise the patch elements would need to be larger still. This also adds to the overall weights of the Huang antenna.

The Kerr patent discloses a microstrip-fed directional antenna which employs a rigid aluminum boom for supporting the parasitic elements, affixed to a circuit board of a dielectric material having a ground plane on one side thereof, and a radiating element in the form of a patch of metal etched on the opposite side of the board. Although both these prior patented antenna designs achieve the wanted directability, the overall weight of these antennas precludes their use when weight is a critical factor for choosing an antenna. In addition, these prior art patented antenna designs are relatively expensive to manufacture.

OBJECTS OF THE INVENTION

It is thus the primary object of the present invention to provide a lightweight multi-element directional antenna which overcomes the aforesaid and other disadvantages of the prior art. A more specific object of the invention is to provide a low cost, low weight, multi-element directional antenna, and a method of producing same.

SUMMARY OF THE INVENTION

The present invention in one aspect provides a novel, multi-element directional antenna comprising a first dielectric substrate having an upper surface and a lower surface, and a metallic foil forming an array of substantially parallel parasitic elements joined by a common backbone, affixed to the upper surface of the first dielectric substrate. A second dielectric substrate, smaller in plan than the first substrate, and having a ground plane reflector on one side thereof and a driven element and phasing means comprising a hybrid (magic or twin) tee junction on the other side thereof, is affixed to the upper surface of the first dielectric substrate, with the ground plane reflector facing the upper surface of the first dielectric substrate, and overlying the backbone in part. The second dielectric substrate is disposed coplanar with the array with the driven element on the second dielectric substrate substantially parallel to the parasitic elements on the first dielectric substrate. The multi-element directional antenna of the present invention may be fabricated using low cost stamping, laminating and circuit board manufacturing techniques.

BRIEF DESCRIPTION OF THE DRAWINGS

Yet other objects and advantages of the present invention may be seen from thee following detailed description taken in conjunction with the accompanying drawings wherein like numerals depict like parts, and wherein.

DETAILED DESCRIPTION OF PREFERRED EMBODIMENT

Figure 1:
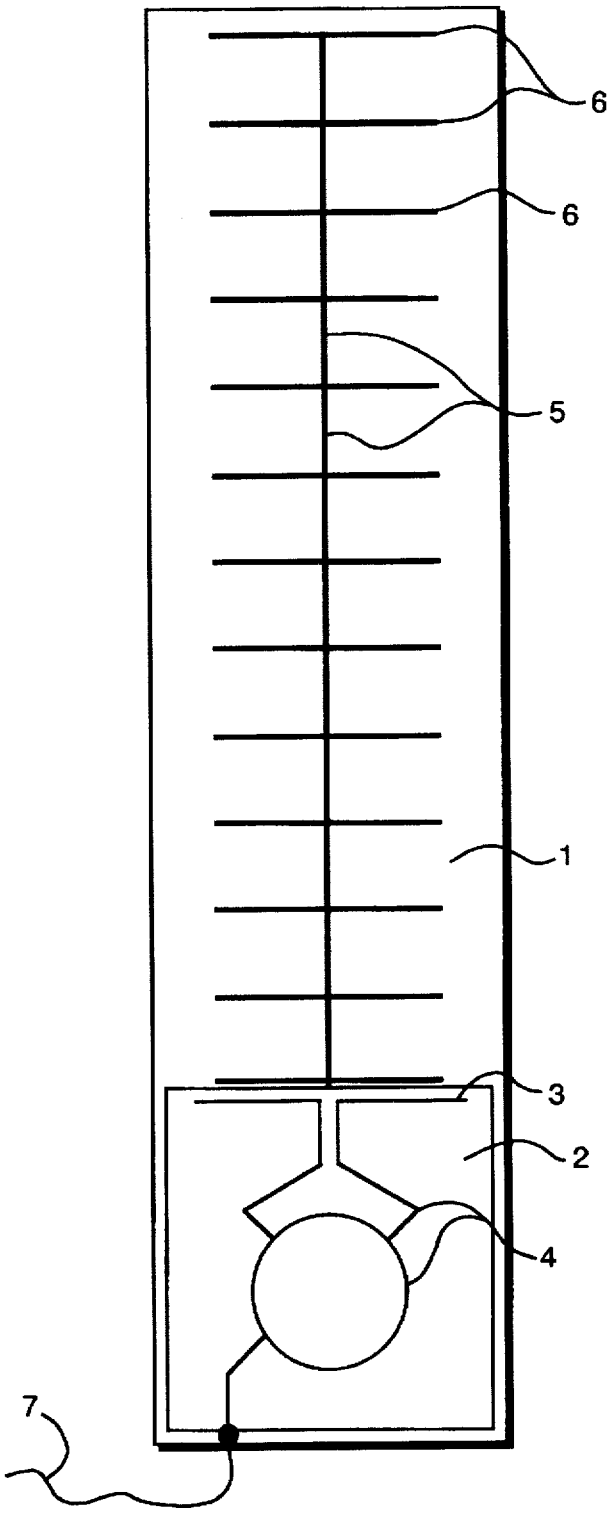
FIG. 1 is a top view of an antenna made in accordance with the present invention.
Figure 2:
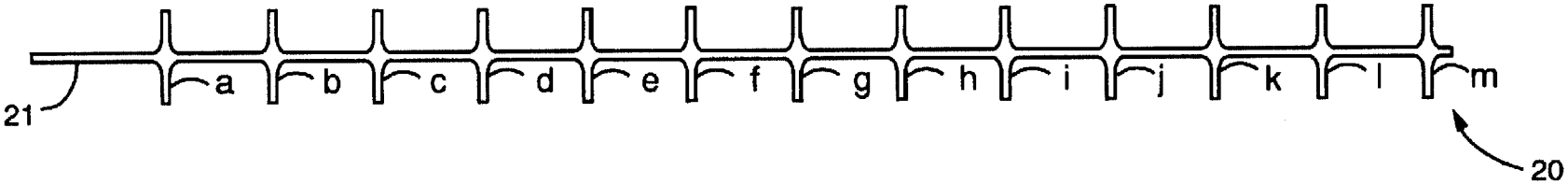
FIG. 2 is a view similar to FIG. 1, and showing details of the parasitic elements of the antenna of the present invention.

Referring to FIGS. 1–4 of the drawings, the multi-element directional antenna of the present invention includes a first dielectric substrate element 1, having disposed on one surface thereof a parasitic element array 20. Also mounted on the one surface; and overlying one end of array 20 is a circuit board 2 that has disposed thereon a signal phasing means 4, driven elements 3, and a source signal feed line 7. The first dielectric substrate element 1 comprises a one-piece foam material, having substantially constant dielectric properties across its surface. In a preferred embodiment of the invention, element 1 comprises ¼ inch thick Polimex TR-55 polymer foam. The manufacturer reports that this foam material has a dielectric constant of about 1.068 and loss tangent of about 0.0013; however other foam materials, including, for example, inexpensive rigid packaging foams, with different dielectric constants and tangent properties advantageously may be employed for a particular application in accordance with the present invention.

Parasitic array 20 comprises a plurality of elements 6 which preferably, but not necessarily, are electrically interconnected to one another by a metallic backbone 5. Parasitic elements 6 are spaced from and run parallel to one another, and perpendicular to backbone 5. The length of the parasitic elements 6 and the spacing between each parasitic element 6 are chosen in accordance with equations well known in the art so as to provide an antenna array that has desired end-fire characteristics and directability. For example, and with reference to FIG. 2, the length and spacing of parasitic elements in accordance with a preferred embodiment of the invention are in accordance with the following table:

| ELEMENT | DISTANCE "D" (IN) | LENGTH "L" (IN) |
|---|---|---|
| a | 3.271 | 2.095 |
| b | 4.248 | 1.991 |
| c | 5.636 | 1.934 |
| d | 7.145 | 1.904 |
| e | 8.724 | 1.868 |
| f | 10.462 | 1.841 |
| g | 12.204 | 1.831 |
| h | 14.075 | 1.814 |
| i | 15.885 | 1.796 |
| j | 17.867 | 1.774 |
| k | 19.445 | 1.703 |
| l | 20.985 | 1.700 |
| m | 22.555 | 1.520 |

Parasitic elements 6 and backbone 5 preferably are formed as a single piece, for example, by etching or stamping a metallic foil such as copper laminated to a dielectric film such as 0.003 inch thick Mylar film, whereby to form array 20 in a single step. Array 20 is then affixed to the first dielectric substrate 1, e.g. by adhesively laminating the array to the substrate, in known manner.

Figure 3:
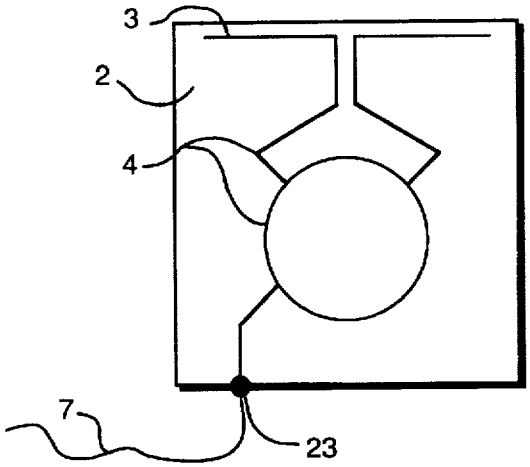
FIG. 3 is a top view of the driven patch portion of the antenna of the present invention.
Figure 4:
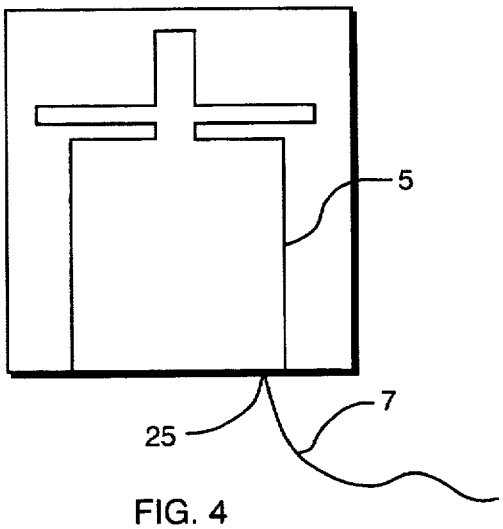
FIG. 4 is a bottom view of the portion of FIG. 3.

It is well understood in the art that in order to achieve linear polarization of the parasitic elements 6, the input signal must be properly phased. Referring in particular to FIGS. 3 and 4, the present invention employs a phasing circuit which comprises a hybrid (magic or twin) tee junction, whereby to exactly match the incoming signals directly without the need for external circuitry. More particularly, circuit board 2 is formed with a hybrid (magic or twin) tee junction 4 on one side, and a ground plane reflector 5 on the other side, overlying the proximal end 21 of array 20, in part. As is known in the art, a hybrid junction is a four-port network in which a signal incident on any one of the ports divides between two output ports with the remaining port being isolated. The assumption is that all output ports are terminated in a perfect match. Under these conditions, the input to any port is perfectly matched. In other words, the hybrid junction 4 splits the input signal and sets up an 180 degree phase shift in the signals which are fed to the driven elements 3 which, in turn, excite the parasitic elements 6. For a further discussion of hybrid (magic or twin) tee junctions, reference is made to Rizzi, *Microwave Engineering Passive Circuits*, Prentice Hall, Chapter 8-2 (1988), and Chatterjee, *Elements of Microwave Engineering* Ellis Harwood Limited, Chapter 8.6 (1986).

The hybrid junction 4, driven elements 3, and the ground plane 5 preferably are formed by etching away the metal on a metal clad dielectric substrate, using printed circuit board subtractive technology. The resulting circuit board is adhesively affixed to the dielectric substrate 1 with the ground plane side 5 facing the dielectric substrate 1, and overlying the proximal end 21 of the backbone 5 of array 20.

Also attached to the back of the circuit board 2 is a source signal feed line 7 which typically is a coaxial cable. The signal line of the source signal feed line 7 is soldered to the hybrid junction 4 side of the circuit board 2 at 23, and the ground line of the source signal feed line is soldered to the ground plane 5 side of the circuit board 2 at 25.

An important feature and advantage of the present invention resides in the use of a hybrid junction 4 which provides balanced feed currents to driven elements 3. It has been heretofore understood in the art that an input signal must be placed on a radiating patch in exact locations to produce a properly phased signal. The hybrid junction 4 of the present invention obviates the need for a large radiating patch to accomplish correct phasing. The etched pattern of the hybrid junction 4 results in a phased signal 180 degrees out-of-phase directly from a signal input at 7. The hybrid junction 4 accepts an incoming signal from the signal source 7 and splits the signal at the oval portion, with the result that the left leg side of the driven element 3 receives a signal that is 180 degrees out-of-phase from the right leg of the driven element 3.

Figure 5:
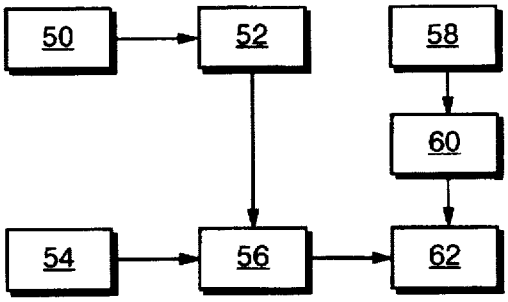
FIG. 5 is a flow diagram showing the manufacturing steps for forming an antenna in accordance with the present invention.

Referring to FIG. 5, the multi-element directional antenna of the present invention can be manufactured using simple low cost manufacturing techniques and materials. The first step is to cut a foam dielectric material in the rectangular shape shown generally in 1, at a cutting station 50. As noted supra, the foam material is selected to provide a substrate with low loss tangent and low dielectric constant properties so that the material will not interfere with effective circular polarization of the antenna. The second step is to place adhesive means such as a double-sided adhesive tape along the entire length of the substrate onto the substrate at a taping station 52. In the meanwhile the parasitic elements 6 are etched or stamped from a single sheet of copper/Mylar foil at a etching station 54. The exact dimensions of manufacture for the parasitic elements are discussed above. The fourth step involves laminating the parasitic elements 6 to the low dielectric constant substrate material using the adhesive tape at laminating station 56. The fifth step involves etching a dual sided printed circuit board 2 in the patterns shown by 3, 4 and 5 at etching station 58, thus forming the driven element, phasing means, and the ground plane reflector, respectively, and soldering a source signal feed line 7, typically a coaxial cable, to the edge of the printed circuit 2 at soldering station 60. Then, the printed circuit board 2 is affixed to the substrate 1 using the adhesive tape at laminating station 62.

From the preceding, it is clear that the multi-element directional antenna, as disclosed, provides a novel signal phasing means and an inexpensive manufacturing process. The resulting antenna is especially low weight and low cost.

Various changes may be made in the above without departing from the spirit and scope of the present invention.

For example, the hybrid junction 4 may be formed using printed circuit board additive technology. Similarly, array 20 also may be formed using printed circuit board additive technology or printed circuit board subtractive technology. However, typically it is most cost effective to form the hybrid junction 4 using printed circuit board subtractive technology, and to form array 20 by punching or steel-rule cutting from a sheet of metal. Also, if desired, a protective cover member (not shown), typically a foam board similar to dielectric substrate element 1, may be affixed over the top array 20, e.g. by means of adhesive tape or the like. Still other changes may be made without departing from the spirit and scope of the present invention.

I claim:

1. A multi-element directional antenna comprising:

a first dielectric substrate;

a metallic foil forming an array of a parasitic elements affixed to a surface of said first dielectric substrate;

a second dielectric substrate smaller in plan than said first dielectric substrate and having a ground plane reflector on one side thereof, and a driven element and phasing means comprising a hybrid junction on the other side thereof, affixed to said surface of said first dielectric substrate with said ground plane reflector side facing said surface of said first dielectric substrate, and, said second dielectric substrate being disposed such that said driven element is substantially parallel to said parasitic elements.

2. A multi-element directional antenna as claimed in claim 1, and further comprising a source feed line affixed to said second dielectric substrate, said source feed line having a ground wire attached to said ground plane reflector and a signal wire attached to said phasing means.

3. A multi-element directional antenna as claimed in claim 1, wherein said second dielectric substrate comprises a double sided printed circuit board, and wherein the ground plane reflector, said phasing means, and said driven element are formed by subtractive techniques.

4. A multi-element directional antenna as claimed in claim 1, wherein said second dielectric substrate comprises a double sided printed circuit board, and wherein the ground plane reflector, said phasing means, and said driven element are formed by additive techniques.

5. A multi-element directional antenna as claimed in claim 1, wherein said second dielectric substrate is affixed to said first dielectric substrate adjacent one end thereof, overlying in part one end of said array.

6. A multi-element directional antenna as claimed in claim 1, wherein said array is formed by stamping.

7. A multi-element directional antenna as claimed in claim 1, wherein said array is formed by etching.

8. A multi-element directional antenna as claimed in claim 1, wherein said array and said second dielectric substrate are affixed to said first dielectric substrate by adhesive means.

9. A multi-element directional antenna as claimed in claim 8, wherein said adhesive means comprises double-sided adhesive tape.

10. A multi-element directional antenna as claimed in claim 1, wherein said first dielectric substrate comprises rigid foam board.

11. A multi-element directional antenna as claimed in claim 1, wherein said phasing means comprises a magic-or-twin tee junction.

12. A multi-element directional antenna as claimed in claim 1, wherein said metallic foil comprises a metal/dielectric film laminate.

* * * * *